US005990784A

United States Patent [19]

Burnett

[11] Patent Number: 5,990,784

[45] Date of Patent: Nov. 23, 1999

[54] SCHMITT TRIGGER LOUD ALARM WITH FEEDBACK

[75] Inventor: George A. Burnett, Coatesville, Ind.

[73] Assignee: Yosemite Investment, Inc., Indianapolis, Ind.

[21] Appl. No.: 08/909,012

[22] Filed: Aug. 8, 1997

Related U.S. Application Data

[63] Continuation-in-part of application No. 08/768,758, Dec. 17, 1996.

[51] Int. Cl.[6] ..... G08B 3/10

[52] U.S. Cl. ..... 340/384.7; 340/384.1; 340/384.4; 340/384.6; 340/384.73; 340/692

[58] Field of Search ..... 340/384.1, 384.4, 340/384.6, 384.7, 384.73, 392.1, 574, 692, 693, 384.72, 628

[56] References Cited

U.S. PATENT DOCUMENTS

| | | | |
|---|---|---|---|
| 4,096,473 | 6/1978 | Sweany et al. | 340/628 |
| 4,157,459 | 6/1979 | Bush et al. | 340/384.6 |
| 4,195,284 | 3/1980 | Hampshire et al. | 340/384.6 |
| 4,213,121 | 7/1980 | Learn et al. | 340/384.6 |
| 4,303,908 | 12/1981 | Enamark et al. | 340/384.6 |
| 4,325,058 | 4/1982 | Wagner et al. | 340/562 |
| 4,352,169 | 9/1982 | Asano | 340/384.6 |
| 4,558,305 | 12/1985 | Black et al. | 340/384.6 |
| 4,803,459 | 2/1989 | Ta | 340/693 |
| 5,019,805 | 5/1991 | Curl et al. | 340/628 |
| 5,313,190 | 5/1994 | Clayton et al. | 340/436 |
| 5,420,570 | 5/1995 | Leitten et al. | 340/574 |
| 5,479,152 | 12/1995 | Walker et al. | 340/545 |

*Primary Examiner*—Daniel J. Wu
*Assistant Examiner*—Toan N. Pham
*Attorney, Agent, or Firm*—Niro, Scavone, Haller & Niro

[57] ABSTRACT

An alarm system circuit comprises a logic array comprising a piezoelectric transducer driven by one or more Schmitt triggers. The logic array operates at substantially resonant frequency, and the circuit provides a feedback loop to sustain the oscillations of the logic array to drive the transducer. In one preferred embodiment, the array includes an additional Schmitt trigger causing the circuit to toggle on and off, thus making a pulsating tone.

8 Claims, 2 Drawing Sheets

SCHMITT TRIGGER LOUD ALARM WITH FEEDBACK

This application is a continuation-in-part of application Ser. No. 08/768,758, filed Dec. 17, 1996 and hereby incorporates that disclosure by reference.

BACKGROUND OF THE INVENTION

The present invention is directed toward an apparatus for a loud audible signal using a minimum of space and power. More specifically, the present invention is directed toward a system comprising a piezoelectric transducer and an integrated circuit which contains a number of Schmitt triggers.

A variety of products from automobiles to household appliances rely upon effective alarms to notify the user of a wide variety of operational messages, including safety concerns. However, currently available alarms are unacceptable or, at best, inefficient in terms of cost, energy requirements, and complexity. Thus, a simple, inexpensive alarm utilizing a low power source is desired.

Piezoelectric transducers are sound producing electronic devices that are preferred by industry because they are by and large extremely inexpensive, reliable, durable, and versatile. This transducer has the unique property that it undergoes a reversible mechanical deformation on the application of an electrical potential across it. Conversely, it also generates an electrical potential upon mechanical deformation. These characteristics make it highly desirable for sound producing applications. When an oscillating potential is placed across the transducer, it vibrates at roughly the same frequency as the oscillations. These vibrations are transmitted to the ambient medium, such as air, to become sound waves. Piezoelectric transducers can also be coupled to a simple circuit in what is known as a feedback mode, well known in the art, in which there is an additional feedback terminal located on the element. In this mode, the crystal will oscillate at a natural, resonant frequency without the need for an external source for applying continuous driving oscillations. As long as the oscillations are in the range of audible sound, i.e., 20 to 20,000 Hertz, such oscillations can produce an audible signal for use as an alarm or an indicator.

Any periodic oscillation can be characterized by at least one amplitude and frequency. Ordinarily, the amplitude of oscillations of interest in a piezoelectric transducer application will be dictated by the voltage swing applied across the element. By the principles explained above, it is evident that there will be a greater mechanical deformation in the crystal with greater applied voltage. The effect is roughly linear within limits, those limits based in general on crystal composition and geometry. Thus, in the linear region, doubling the voltage swing doubles the mechanical deformation. Doubling the mechanical deformation significantly increases the amplitude of vibrations transmitted into the ambient medium. Increased amplitude of vibrations in the medium causes an increased sound level, the relationship determinable by well known physical equations.

More specifically, when a piezoelectric element possesses two terminals and a driving oscillation is placed across one while the other is clamped to a common potential such as ground, the voltage swing will be at most the amplitude of the oscillations. Thus, if an oscillation of amplitude of 5 volts is placed across one terminal, while the other is maintained at 0 volts, the maximum voltage swing will be 5 volts. This effectively caps the achievable decibel level of any sound to a value corresponding to the supply voltage. One could double the supply voltage to achieve double the voltage swing, but this has the disadvantage of added cost, and further is impractical when a piezoelectric audio circuit is to be placed in a unit having a standardized voltage supply such as an automobile. Alternatively, one could use a second supply disposed to provide the same oscillations but in a reversed polarity to double the effective voltage swing. But this approach possesses at least the same disadvantages.

As shown by the present invention, when a piezoelectric element possesses two terminals and a driving oscillation is placed across one, and the identical driving oscillation is placed across the other but shifted 180 degrees out of phase, the voltage swing will be about two times the amplitude of the oscillations. By "180 degrees out of phase" it is meant that each terminal generates a signal having a substantially square wave form, wherein one wave form is high and the other is low at any given time. Thus, if an oscillation having an amplitude of 5 volts is placed across one terminal while the other experiences the same oscillation but separated by 180 degrees of phase (half the period of the cycle), then the maximum voltage swing will be 10 volts. Higher sound pressures and louder tones result with a voltage swing of 10 volts than with a voltage swing of 5 volts.

As shown by the present invention, the phase shift needed to effectively double the voltage swing across the transducer can be accomplished by use of one or more Schmitt triggers. It is believed that Schmitt triggers are particularly useful to the present invention because of the fast switching time and because they require minimal addition of components. Schmitt triggers are a special type of bistable amplifier circuit known in the art which can sustain two different voltages, each being equal in amplitude but 180 degrees out of phase. Schmitt triggers further have regenerative capability through the use of a feedback loop. In other words, Schmitt triggers can be started or triggered by an initial pulse of only a short duration and can be maintained indefinitely (for all practical purposes) in one of their bistable states through its own feedback, without the need for an external source to supply continuing driving oscillations. Furthermore, Schmitt triggers have the added benefit of producing either a high or low output in response to a trigger signal, depending upon the state that the circuit is already in. In other words, where the input voltage is between the low and high threshold voltages of each of the stable states of a Schmitt trigger, the output of the Schmitt trigger is inverted from high to low, or vice versa. This feature can be used to place alternating voltage drops of equal magnitude across opposing terminals of a transducer, thus increasing the mechanical deformation in the transducer.

Particularly in alarm applications, what is needed is a loud sound that does not depend on the added circuit complexity of a doubled supply voltage or an additional reversed polarity supply. Loud sounds require relatively high voltages to produce relatively large amplitude vibrations in the transducer. In a special analog circuit, this might not be an obstacle. However, in a circuit containing elements that are safely and reliably operable only in a limited range of potentials, accommodations must be made to insure that those elements do not receive an electrical potential that is too high. Thus, in particular when a loud alarm sound is needed, care must be taken to separate the potentials driving the transducer from the potentials driving the more sensitive circuit elements. For example, integrated circuits often have specifications limiting the recommended power supply to 5 volts DC. If one desires to power a transducer using a supply voltage of 16 volts DC, care must be taken to regulate the power supplied to the integrated circuit.

Accordingly, one object of the present invention is inexpensively to enable loud sounds to be generated by an audio circuit that overcomes the foregoing disadvantages.

Still another object of the invention is to enable the use of voltage-sensitive components in the same circuit that contains an audio transducer that is disposed to receive large voltage swings.

Yet another object of the present invention is to provide a simple, inexpensive, low power device that creates a loud alarm for users.

Another object of the present invention is to utilize feedback from the audible alarm to facilitate the continued operation of the alarm.

Yet another object of the present invention is to utilize an array of Schmitt triggers to increase the voltage across a piezoelectric transducer so as to maximize the resonance of the resulting alarm signal.

Still another object of the present invention is to utilize another Schmitt trigger to toggle the oscillation of the circuit on and off, thus creating a distinct, intermittent audible alarm.

SUMMARY OF THE INVENTION

These and other objects of the present invention are achieved by the driving circuit of the present invention. The driving circuit comprises an amplifying stage having multiple logic gates, including at least one Schmitt trigger. The Schmitt trigger enables a voltage swing of approximately twice the voltage supply across the piezoelectric transducer by ensuring that the two supply terminals for the transducer oscillate 180 degrees out of phase with each other. A feedback loop enables a signal to be transmitted back through the logic gates to permit a continuing signal.

In one preferred embodiment of the invention, the signal placed across the transducer is made intermittent by the use of an oscillator circuit. The oscillator circuit preferably includes one Schmitt trigger and operates at a lower frequency, intermittently interrupting the feedback signal to the driving circuit. This causes the driving circuit to toggle on and off, thus creating a pulsating tone. By contrast, in normal operation, i.e., when the oscillator circuit does not interrupt the driving circuit, a feedback signal from the piezoelectric transducer supplies a signal to the driving circuit in a manner designed to stabilize the signal generated by the transducer. When the feedback signal is routed through the inverter array, the voltage swing can be about as high as twice the supply voltage. In a second preferred embodiment, the signal is maintained continuously —thus, no toggle circuit is needed.

DETAILED DESCRIPTION OF THE PREFERRED EMBODIMENT

Figure 1:
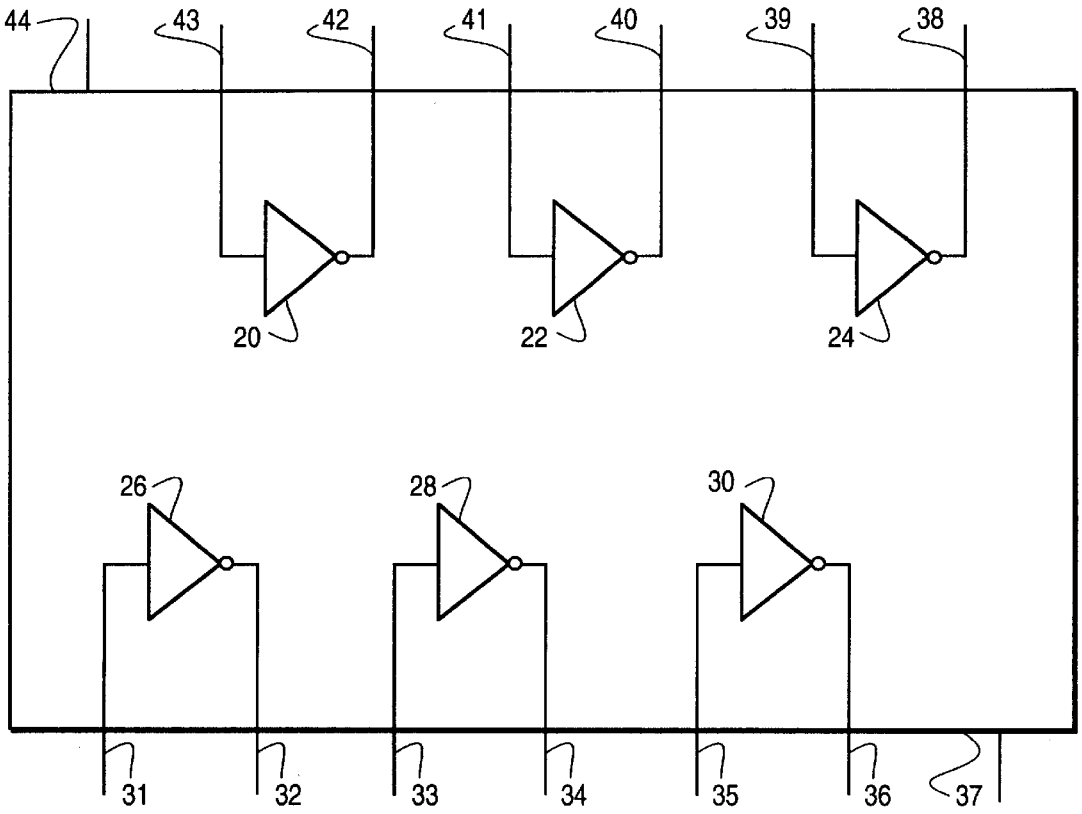
FIG. 1 is a schematic showing the integrated circuit of the present invention.

Directing attention to FIG. 1, a detailed electric circuit diagram of a preferred embodiment of the invention is shown. Preferably, the present invention utilizes a schmitt trigger circuit having a six input inverter logic array, most preferably a NATIONAL SEMICONDUCTOR brand MM 74C14 N logic array, although many different logic arrays will suffice to perform the functions outlined below. As can be seen from this figure, schmitt trigger circuit 10 contains six inverters or Schmitt triggers, 20, 22, 24, 26, 28, 30, and fourteen pin locations, 31–44.

Figure 2:
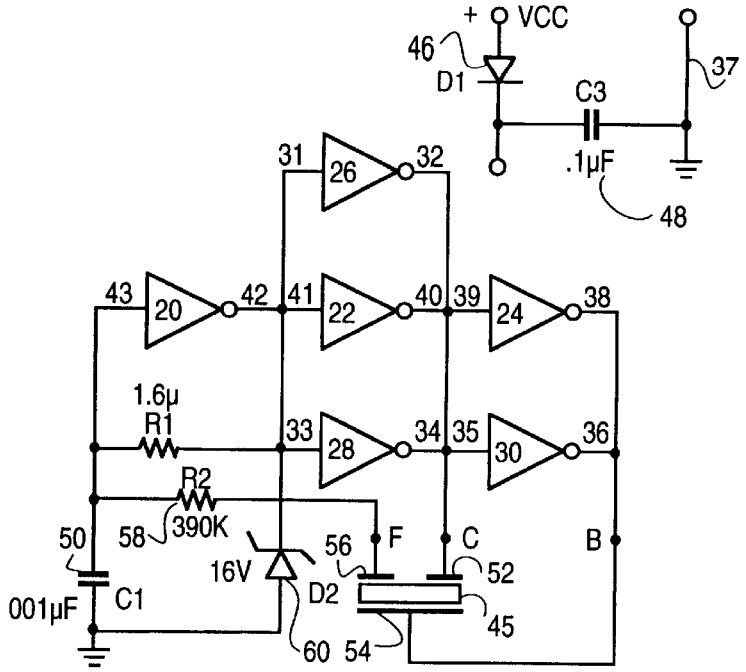
FIG. 2 is an operational schematic showing the intermittent driving circuit of the first preferred embodiment of the present invention in combination with an audio transducer.
Figure 3:
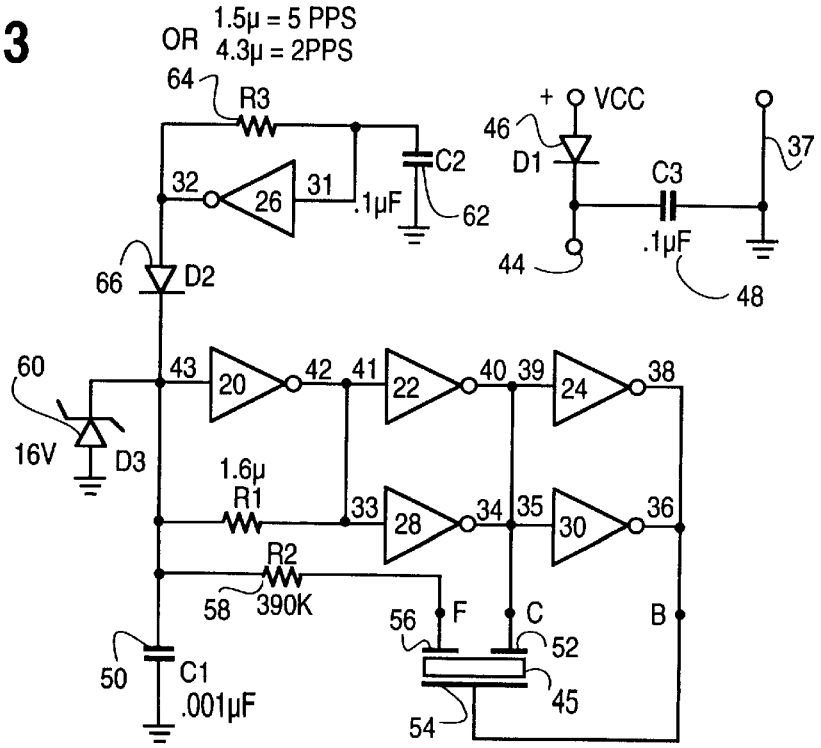
FIG. 3 is a schematic showing the continuous driving circuit of the second preferred embodiment of the present invention in combination with an audio transducer.

FIG. 2 refers to an operational schematic showing the Schmitt trigger array working in combination with a audio transducer, such as piezoelectric transducer 45. Piezoelectric transducer 45 can be of any variety. Typical one contain a brass or stainless steel inner disk, and are presently rated for recommended maximum voltage supplies of 30 volts peak-to-peak (about 22 volts RMS). Pins 36 and 38 are coupled to each other and to the other terminal of piezoelectric transducer 45. Pin 37 is coupled to ground. As is shown in FIGS. 1–3, inverter or Schmitt trigger 20 has an input coupled to pin 43 and an output coupled to pin 42. Schmitt trigger 22 has an input coupled to pin 41 and an output coupled to pin 40. Schmitt trigger 24 has an input coupled to pin 39 and an output coupled to pin 38. Schmitt trigger 26 has an input coupled to pin 31 and an output coupled to pin 32. Schmitt trigger 28 has an input coupled to pin 33 and an output coupled to pin 34. Schmitt trigger 30 has an input coupled to pin 35 and an output coupled to pin 36.

Power enters the circuit through power supply pin 44. Typically, continuous voltage is supplied across this pin in the range of about 6 to 16 volts of direct current. A power supply switch (not shown) may be inserted with the power supply pin 44 in any manner as is known in the art to control activation of the entire circuit. Diode 46 forward biases the current to prevent backflow into the power supply terminal. Power supply pin 44 is further connected to capacitor 48 which leads to ground. Preferably, capacitor 48 has a value of about 0.1 microfarad, which enables transients or surges to be grounded while providing uniform potential for pin 44.

The power supply 44 charges a capacitor 50 of about 0.001 microfarad value. Capacitor 50 then sends a pulse to pin 43. Schmitt trigger 20 generates a signal from the input pin 43 when the pulse on pin 43 exceeds the threshold of the Schmitt trigger. This Schmitt trigger inverts the incoming potential on pin 43. More specifically, when pin 43 is high, pin 42 is low. Conversely, when pin 43 is low, pin 42 his high. High potential on pin 43 is the supply potential. Now the output of Schmitt trigger 20 on pin 42 becomes the input of parallel inverting gates (Schmitt triggers) 22 and 28. At this point, the outputs of inverters 22 and 28 are fed to one terminal 52 of piezoelectric transducer 45 and simultaneously into the inputs of parallel inverters 24 and 30. The outputs of inverters 24 and 30 are concurrently fed into a second terminal 54 of piezoelectric transducer 45.

In this way, when Schmitt trigger 22 generates a potential at pin 40, Schmitt triggers 22 and 28 provide the same amplitude of potential, as Schmitt triggers 24 and 30, albeit 180 degrees out of phase with one another. As a result, the effective potential swing across transducer 45 is about double the amplitude of the signals generated by either single set of parallel inverters, therefore generating a more powerful audible signal. In the most preferred embodiment of this invention, the Schmitt triggers 22 and 28 (as well as triggers 24 and 30) are used in parallel so as to achieve greater current additive capability. Specifically, in the most preferred embodiment of the invention, Schmitt trigger 22, by itself, generates only about 8 milliamperes of current on the line, which is believed to be insufficient to operate transducer 45 in a satisfactory manner. Thus, Schmitt triggers 22 and 28 work in parallel to give about 16 milliamperes of current.

The output of Schmitt triggers 22 and 28 are sent to a first transducer electrode 52, and the output of Schmitt triggers 24 and 30 are sent to a second transducer electrode 54. The outputs of these electrodes cause mechanical deformation in the transducer 45, thus generating sound waves. Piezoelectric transducer 45 operates at substantially resonant frequency and is therefore a piezo resonant transducer. This sound generated by transducer 45 creates a voltage signal received by the feedback terminal 56 and fed back through current limiting resistor 58 to regenerate a signal through Schmitt trigger 20. Zener diode 60 is placed in conjunction with pin 43 so as to prevent excessive voltage in the feedback from damaging the Schmitt triggers. Through this configuration, the feedback portion of the transducer 45 causes the Schmitt trigger to operate at the resonant frequency of the transducer without the need for continuous driving oscillations from another source, such as capacitor 50 and resistor 62. In the most preferred embodiment of this invention, the resonant frequency most causes oscillations of about 3000 hertz, although any frequency between 20–20, 000 hertz could be used.

As can be shown in FIG. 2, a first preferred embodiment of the present invention employs the use of an additional toggle circuit based upon the use of Schmitt trigger 26. Schmitt trigger 26 works in conjunction with capacitor 62, resistor 64 and diode 66 to generate oscillations of about 2 to 5 hertz. Depending upon the values of the resistor and capacitor, the oscillator circuit will periodically interrupt the signal placed upon pin 43, ultimately generating an audio signal for the listener of about 2 to 5 pulses per second. Specifically, when pin 32 is switched to a given state, it pulls pin 43 to a constant state, thus temporarily interrupting the feedback signal. In its most preferred state, this embodiment uses either values of 0.1 microfarads for capacitor 62 and 1.5 megaohms for resistor 64 to generate ultimately 5 audible pulses per second out of transducer 45, or the resistor can be valued at 4.3 megaohms to produce 2 audible pulses per second.

As can be seen in FIG. 3, the second preferred embodiment of the present invention is focused on the creation of a continuous signal. In this instance, Schmitt trigger 26 is not used as the basis of a separate toggling circuit, but instead operates in parallel with Schmitt triggers 22 and 28. The additional current on the line generated by Schmitt trigger 26 is not necessary to operate transducer 45, but merely augments that of the other elements of the logic array.

Of course, it should be noted that various changes and modifications to the preferred embodiments of this invention will be apparent to those skilled in the art; such changes and modifications can be made without departing from the spirit and scope of the present invention. For instance, other audio transducers could be employed besides a piezoelectric transducer. Also, other inverters could be used, such as NAND gates. Likewise, a continuing driving signal could be supplied from a capacitor or other source in place of the feedback signals from the transducer. It is, therefore, intended that such changes and modifications be covered by the following claims.

What is claimed is:

1. A circuit for generating electrical oscillations in an audio transducer, said circuit comprising:

first and second Schmitt triggers each having a respective Schmitt trigger input and Schmitt trigger output, the second Schmitt trigger input electrically coupled to the first Schmitt trigger output;

input means for receiving a sequence of electrical oscillations at the first Schmitt trigger input, said oscillations being essentially in the audible frequency range, said input allowing a high potential state to appear at the first Schmitt trigger input during one of respective high and low phases of the oscillations and a low potential state to appear during the other of respective high and low phases of the oscillations;

first terminal means electrically connected to said first Schmitt trigger output for transmitting electrical oscillations directly to an audio transducer; and second terminal means electrically connected to said second Schmitt trigger output for transmitting electrical oscillations directly to an audio transducer.

2. The circuit of claim 1 further comprising third and fourth Schmitt triggers each having a respective Schmitt trigger input and Schmitt trigger output, the third Schmitt trigger input connected in parallel with the first Schmitt trigger input and the fourth Schmitt trigger input connected in parallel with the second Schmitt trigger input.

3. The circuit of claim 2 wherein the third Schmitt trigger output is connected in parallel with the first Schmitt trigger output to said first terminal means and the fourth Schmitt trigger output is connected in parallel with the second Schmitt trigger output to the second terminal means.

4. The circuit of claim 3 wherein the input means comprises a feedback terminal for receiving a resonant signal from an audio tradsducer, said resonant signal being supplied to said driving circuit so as to sustain further signals generated by said first, second, third and fourth Schmitt triggers.

5. The circuit of claim 3 wherein the audio transducer is a piezoelectric transducer.

6. A circuit for generating electrical oscillations in the audible frequency range comprising means for providing a supply voltage;

a driving circuit coupled to the supply voltage and supplying a voltage amplitude of about twice the supply voltage, said driving circuit including a first pair of parallel inverters, said parallel inverters generating a signal, the signal of said first pair being provided to a second pair of inverters and a first electrode; said second pair of inverters generating a second signal to a second electrode;

an audio transducer connected to said first and second electrodes, said transducer mechanically deforming in response to said first and second signals so as to produce an audible alarm thereby.

7. The circuit of claim 6, further comprising a feedback terminal for receiving a resonant signal from said transducer, said resonant signal being supplied to said driving circuit to as to sustain further signals generated by said first and second parallel inverters.

8. The circuit of claim 7, further comprising an oscillating circuit for periodically interrupting said resonant signal from said transducer, said oscillating circuit including at least one inverter.

* * * * *